US005209069A

United States Patent [19]

Newnan

[11] Patent Number: 5,209,069

[45] Date of Patent: May 11, 1993

[54] COMPACT THERMOELECTRICALLY COOLED BEVERAGE DISPENSER

[75] Inventor: Brian D. Newnan, Louisville, Ky.

[73] Assignee: Grindmaster Corporation, Louisville, Ky.

[21] Appl. No.: 696,178

[22] Filed: May 6, 1991

[51] Int. Cl.[5] ..... F25B 21/02

[52] U.S. Cl. ..... 62/3.64; 222/146.6

[58] Field of Search ..... 62/3.64, 3.1, 3.2; 222/146.1, 146.6

[56] References Cited

U.S. PATENT DOCUMENTS

| | | | |
|---|---|---|---|
| 3,250,433 | 5/1966 | Christine et al. | 222/146.6 X |
| 3,255,609 | 6/1966 | Jacobs et al. | 222/146.1 X |
| 3,269,606 | 8/1966 | Armstrong | 222/146.1 X |
| 3,341,077 | 9/1967 | Gordon | 222/146.1 X |
| 3,445,039 | 5/1969 | Brodsky et al. | 62/3.64 X |
| 4,450,987 | 5/1984 | Boettcher et al. | 222/641 |
| 4,757,920 | 7/1988 | Harootian, Jr. et al. | 222/146.6 |
| 4,913,713 | 4/1990 | Bender et al. | 62/3.61 |

FOREIGN PATENT DOCUMENTS 2301494 1/1974 Fed. Rep. of Germany ... 222/146.6

*Primary Examiner*—Henry A. Bennet
*Assistant Examiner*—William C. Doerrler
*Attorney, Agent, or Firm*—Camoriano & Smith

[57] ABSTRACT

A thermoelectrically cooled beverage dispensing machine of the commercial type such as used in restaurants, movie theaters and the like featuring compact construction is disclosed. The cooling system employs a plurality of heat exchanger fins or plates which define a void space therein in which a fan motor is disposed, thus saving either substantial height, width or depth in the housing containing the cooling system. The air circulation fan motor of the cooling system is also used as the prime mover for a magnetic drive disc which, in turn, operates a magnetically driven liquid impeller located within a beverage container for agitating the beverage to create a pleasing dynamic fluid display which is also a space saving feature in thermoelectrically cooled beverage display systems. A multi-bowl thermoelectrically cooled beverage dispensing machine having these same advantageous features is also disclosed.

11 Claims, 3 Drawing Sheets

COMPACT THERMOELECTRICALLY COOLED BEVERAGE DISPENSER

BACKGROUND OF THE INVENTION

This invention relates generally to thermoelectrically cooled beverage dispensing machines and, more specifically, to such machines which feature heretofore unachieved compact construction.

Broadly speaking, thermoelectrically cooled beverage dispensing machines are known in the prior art. See, for example, the thermoelectrically cooled beverage dispenser adapted for mounting in a vehicle over the transmission hump on a vehicle floor as disclosed in U.S. Pat. No. 4,384,512 issued to G. R. Keith on May 24, 1983. See also the thermoelectrically cooled liquid dispenser of the commercial type which may be used to dispense cream for coffee in restaurants as disclosed in U.S. Pat. No. 3,445,039 issued to B. Broadsky et al. on May 20, 1969. See also the thermoelectric water cooler disclosed in U.S. Pat. No. 3,368,359 issued to W. A. English, et al. on Feb. 13, 1968, and the thermoelectric liquid cooler of U.S. Pat. No. 3,174,291 issued to W. R. Crawford et al. on Mar. 23, 1965. See also the thermoelectric water cooler in U.S. Pat. No. 4,829,771 issued to E. E. Koslow, et al. on May 16, 1989, and the thermoelectric wine bottle cooler disclosed in U.S. Pat. No. 4,681,611 issued to H. J. Bohner on Jul. 21, 1987. Lastly, see the thermoelectric water cooler disclosed in U.S. Pat. No. 3,310,953 issued to J. M. Rait on Mar. 28, 1967, and the portable thermoelectric beverage chiller of U.S. Pat. No. 4,320,626, issued to J. H. Donnelly on Mar. 23, 1982.

All of the above referenced patents disclose thermoelectric coolers for liquid having heat exchange fins or plates except the patents to Koslow et al. and English et al., both of which have heat exchanger tubes. The device of English et al. is the only one of the reference patents which does not employ forced air circulating means such as a fan or pump. Of the group of prior art patents cited which employ both a plurality of heat exchange fins or plates and fans, in each of those references the fan and plates are mounted vertically in tandem, which requires a high profile assembly, except the systems of Bronsky et al. and Rait which plates and fans are mounted horizontally in tandem. While the latter two systems thus save height, they sacrifice depth or width.

Also, none of the reference patents previously cited employ means for agitating a liquid beverage in a transparent display container for the purpose of circulating the beverage against a roof of the container to create a flow of beverage across the roof by means of surface tension and thence down the sides of the bowl to form an aesthetically pleasing and appetizing dynamic fluid display. And while there is nothing new per se about such dynamic beverage display, the use of a single prime mover to control both air circulation through the cooling system and agitation of the beverage in the display bowl to provide a dynamic fluid display is new.

Accordingly, by means of my invention, these and other disadvantages encountered in the use of prior art thermoelectrically cooled beverage dispensers are substantially overcome.

SUMMARY OF THE INVENTION

It is an object of my invention to provide a thermoelectrically cooled beverage dispensing machine.

It is a further object of my invention to provide a thermoelectrically cooled multi-bowl beverage dispensing machine.

It is another object of my invention to provide a thermoelectrically cooled beverage dispensing machine of compact construction.

It is also an object of my invention to provide a thermoelectrically cooled beverage dispensing machine wherein a single fan motor is employed as a prime mover for both air circulating means and an impeller for agitating a beverage stored in the machine.

Briefly, in accordance with my invention, I provide an improved refrigerated dispensing machine. The machine conventionally includes a housing and a thermally conductive, magnetically permeable support plate attached to the housing. A conventional transparent beverage container disposed on the support plate and a drive motor disposed within the housing are also provided. A conventional magnetic drive means responsively connected to the motor and disposed in the housing next to the support plate, and a magnetized liquid circulating means rotatably disposed in the container and responsively coupled, magnetically, to the drive means is also provided.

The improvement I provide includes a thermoelectric refrigerating system disposed in the housing for removing heat from the support plate to cool a beverage stored in the container, and air circulating means disposed in the housing for drawing ambient air into the housing to extract heat from the refrigerating system and for exhausting such air, so heated, from the housing, the air circulating means also being responsively connected to the motor.

These and other objects, features and advantages of my invention will become apparent to those skilled in the art from the following detailed description and attached drawings upon which, by way of example, only the preferred embodiments of my invention are described and illustrated.

DESCRIPTION OF THE PREFERRED EMBODIMENTS

Figure 1:
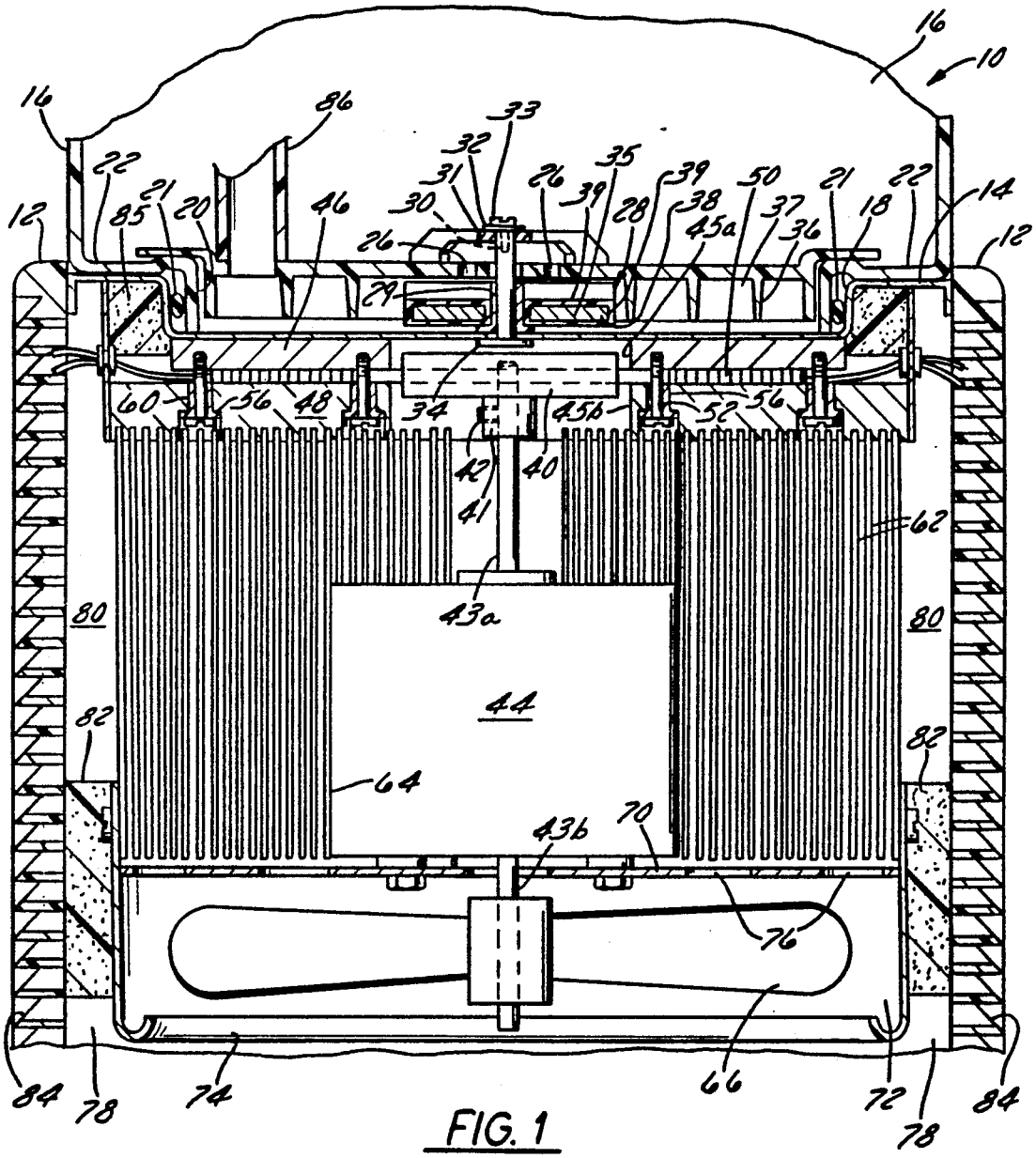
FIG. 1 shows a front elevation view of a thermoelectrically cooled beverage dispensing machine with forward portions as viewed being torn away for interior viewing, thus illustrating one preferred embodiment of my invention.
Figure 2:
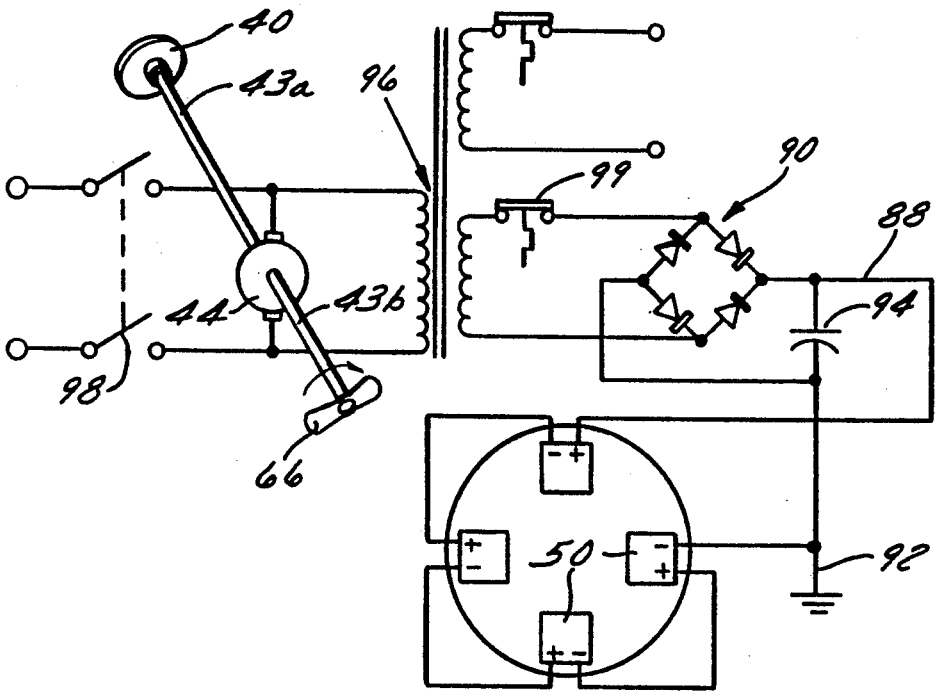
FIG. 2 shows an electrical wiring diagram for the cooling system of the machine of FIG. 1.
Figure 3:
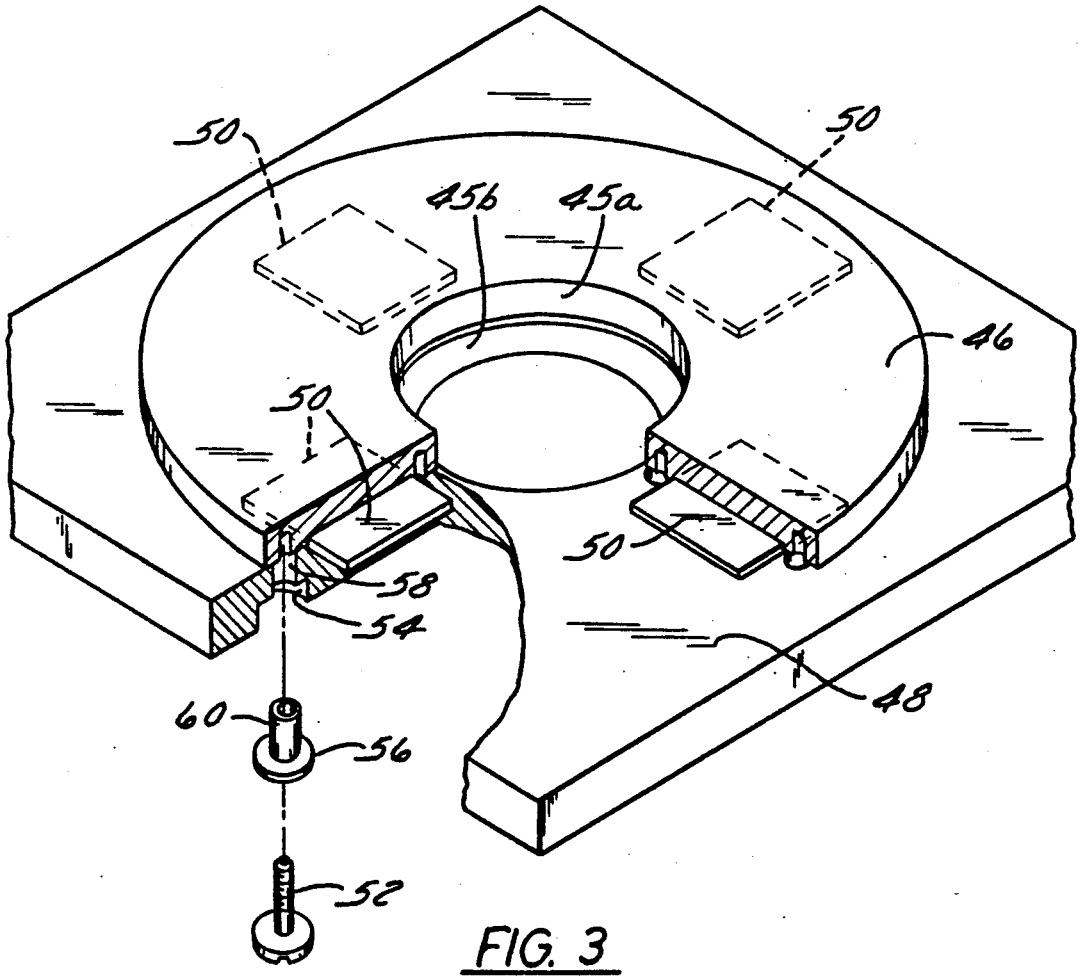
FIG. 3 shows a perspective view of a portion of the thermoelectric cooling system of the machine of FIG. 1.

Referring now to drawing FIGS. 1-3 there is shown, in one preferred embodiment of my invention, a refrigerated beverage dispensing machine generally designated 10 which includes a housing 12, a thermally conductive, magnetically permeable support plate 14 constructed of aluminum, stainless steel or the like, attached to the housing 12 in any suitable manner, and a transparent container 16 disposed on the plate 14 for storing a beverage in a refrigerated state prior to being dispensed. The support plate 14 contains a circular recess 18 in which a circular collar 20 defining a circular opening in a base plate 22 of the container 16 rests, the floor of support plate 14 in the recess 18 thus forming a portion of the floor of the container 16. A resilient circular gasket 21 is disposed between and around the vertical defining walls of the recess 18 and collar 20 to prevent liquid flowing on the floor of the recess 18 from seeping out of the container 16. The opening defined by the collar 20 contains a cap or cover 24 having a series of apertures 26 therethrough located on and around a central portion thereof. A conventional magnetized agitator disc or impeller 28 is rotatably disposed between the cover 24 and the support plate 14 in a central circular portion of the recess 18 under the apertures 26. The impeller 28 is rotatably mounted on a shouldered sleeve bearing 29 which is, in turn, fixedly but removably mounted on a stationary shouldered pin 30. A three legged frame 31, only two legs of which are shown, is connected on distal ends thereof to and around an upper surface of the cover 24 and contains a central portion which is spaced above a central portion of the circular cover 24 and support plate recess 18. An upper end of the pin 30 is held in place against the central portion of the frame 31 by means of a washer 32 and screw 33. The pin 30 extends from the central portion of the frame 31 downward through a central opening in the center of the cover 24, through the sleeve bearing 29 and surrounding impeller 28 and through an opening in the support plate 14 formed in the center of the recess 18. A shoulder 34 on a lower end of the pin 30 bears against the underside of the support plate 18, whereby the pin 30 joins the cover 24 to the support plate 18. The cover 24 is thus held tightly in the recess 18 between the washer 32 and screw 33, on one end of the pin 30, and the shoulder 34 and support plate 18 on the other end thereof. However, the rotatable impeller 28 is held off the floor of the support plate 18 by a lower shoulder of the sleeve bearing 29 so that the impeller 28 will be readily rotatable.

As is conventional, the upper surface of the disc shape impeller 28 contains a series of raised fins or blades 35 which extend radially outward from the center of the impeller 28 to its periphery. Thus liquid which flows downward through the apertures 26 in the cover 24 is slung outwardly by the rotating impeller 28 so as to be forced through an expanding spiral path formed by walls 36 which depend from the cover 24 and which define a spirally extending channel 37 in a horizontal plane. As the beverage circulates in such an expanding spiral path around and across the support plate recess 18, it is cooled by the refrigeration system as later described. Ultimately, the spiral path under and about the cover 24 leads to a riser tube 86 wherein the cooled beverage rushes upwardly to splash against a roof of the transparent container 16 to thus flow down around the sides of the container 16 to join the remaining liquid, thus creating an aesthetically pleasing, appetizing and dynamic fountain-like display.

The body of the impeller 28 below the fins 35 contains a series of magnetized, ferromagnetic elements 38 disposed therearound which are completely encased in plastic 39 so as not to contact the beverage in the container 16 and thus be subject to the release of rust products. A rotatable magnetic drive disc 40 is located just under the support plate 14 in registry with the impeller 28 and is connected by means of a collar 41 and set screw 42 to a drive shaft 43*a* of an electric motor 44. The magnetic drive disc 40 is located within a circular opening 45*a* and *b* formed in and extending through a cold plate 46 and a hot plate 48 respectively. The opening 45*a* and *b* is sufficiently larger in diameter than the diameter of the drive disc 40 to allow the latter to turn freely on the shaft 43*a* without rubbing the opening defining surfaces of plates 46 and 48. A series of conventional thermoelectric heat pump modules 50, such as those manufactured by Materials Electronic Products Corporation, 990 Spruce Street, Trenton, N.J. under the trademark MELCOR, are sandwiched between and spaced around the cold and hot plates 46 and 48.

The plates 46 and 48 are constructed of a thermally conductive material such as aluminum plate or the like and are mechanically connected tightly together with the modules 50 tightly sandwiched therebetween by means of machine screws 52, taking care that the plates 46 and 48 do not touch one another. The screws 52 are tapped into the cold plate 46 and are insulated from the hot plate 48 to prevent heat flow therethrough and consequent loss of cooling efficiency of the assembly. In the present example, the head of each of the screws 52 seats within an oversize countersink 54 formed in a bottom surface portion of the hot plate 48 against a thermally insulative shouldered fiber washer 56. The shank of each of the screws 52 extends through a sleeve portion 60 of the washer 56, which is inserted in an oversized hollow shaft 58 in the hot plate 48 and is thereafter threaded into a lower surface portion of the cold plate 46. A thermally conductive joint compound is coated to the opposing surfaces of each of the plates 46 and 48 which contact the modules 50 to assure good thermal contact. I recommend using Type 120 thermal joint compound as manufactured and sold by Wakefield Engineering, of Wakefield, Mass.

An upper surface of the disc shaped cold plate 46 is connected to the underside of the circular recess 18 of the support plate 14 so as to be in efficient thermal contact therewith. I recommend the use of a suitable epoxy glue impregnated with aluminum filings such as that sold under the trademark Delta Bond 154. The hot plat 48 is rectangularly shaped and contains a series of spaced apart, paralleled extending channels in a lower surface portion thereof in which are inserted edges of a plurality of rectangularly shaped cooling fins or heat exchanger plates 62. A lower central portion of the plates 62 defines a void space 64 in which the motor 44 is disposed. By placing the motor 44 within a space defined by the plates 62, as opposed to being placed below or beside the plate package, considerable space saving is realized which materially contributes to the compactness of the machine 10. In addition to driving the magnetic drive disc 40, the motor 44 also drives a cooling fan 66 located on a drive shaft 42*b* below the plates 62 and a cover plate 70 in a fan housing 72. The drive shaft 42*b* is, of course, an extension of the shaft 42*a*. The fan housing 72 contains a circular opening 74 in the base thereof and the cover plate 70 contains a series of circular openings 76 to permit ambient air to be drawn by the fan 66 through the fan housing 72 and forced into and between the heat radiating plates 62. The housing 12 is divided vertically into an air inlet lower portion 78 and an air outlet upper portion 80 by means of strips 82 of low density, closed cell, polyurethane foam which extend completely around the fan housing 72 and extend between the latter and the inside surfaces of the sidewalls of the housing 12 in an essentially air tight manner.

Ambient air is thus drawn by the fan 66 into the air inlet lower portion 78 of the housing 12 through a first series of louvers 84 located below the strips 82, thence through the opening 74 and the fan housing 72 and is thereafter forced through the cover plate openings 76, heat radiating plates 62, and, finally into the air outlet portion 80 of the housing 12 above the strips 82 where it is exhausted back to ambient through a second series of the louvers 84 located above the strips 82. The fan motor 44 thus drives both the air circulating fan 66 and the magnetic drive disc 40, the latter being magnetically coupled to the magnetized impeller 28 for circulation of the beverage in the container 16 to both cool the same and create a dynamic fluid display in the transparent container 16. As the impeller 28 rotates, liquid beverage stored in the container 16 which has flowed downward through the openings 26 in the cover 24 is agitated in a well known manner to flow through the spiral or vortex guide formed on the underside of the cover 24 by the walls 36 until it reaches the riser tube 86 wherein it is forced against a roof of the container 16, thus causing it to flow down all sides of the container 16 to present a pleasing and appetizing appearance.

The electrical circuitry of the thermoelectric cooling assembly includes the modules 50, electrically connected to one another in a suitable and well known manner between an output line 88 of a conventional full wave bridge rectifier 90 and ground 92. FIG. 2 shows the modules 50 being electrically connected in series with one another but they could also be connected in parallel. Any a.c. ripple emitted by the rectifier 90 is essentially shorted to ground 92 in the usual, well known manner by a suitable capacitor 94. The rectifier 90 receives an a.c. input potential from a secondary winding of a transformer 96, the primary side of which is connected across the fan motor 44. A single pole, double throw switch 98 connects a commercial a.c. potential to the fan motor 44 and the primary winding of the transformer 96 when closed. A conventional thermostatically controlled ON/OFF switch 99 connected between a secondary winding of the transformer 96 and the rectifier 90 allows the thermoelectric cooling system to be automatically activated when the cold plate temperature is above a predetermined value and de-activated otherwise. A second secondary winding of the transformer 96 can be connected to a second bridge rectifier circuit, similar to the rectifier 90, to supply a d.c. operating potential to a second thermoelectric refrigerating system such as used in the dual bowl assembly shown in FIGS. 4–5 as will now be explained.

Figure 4:
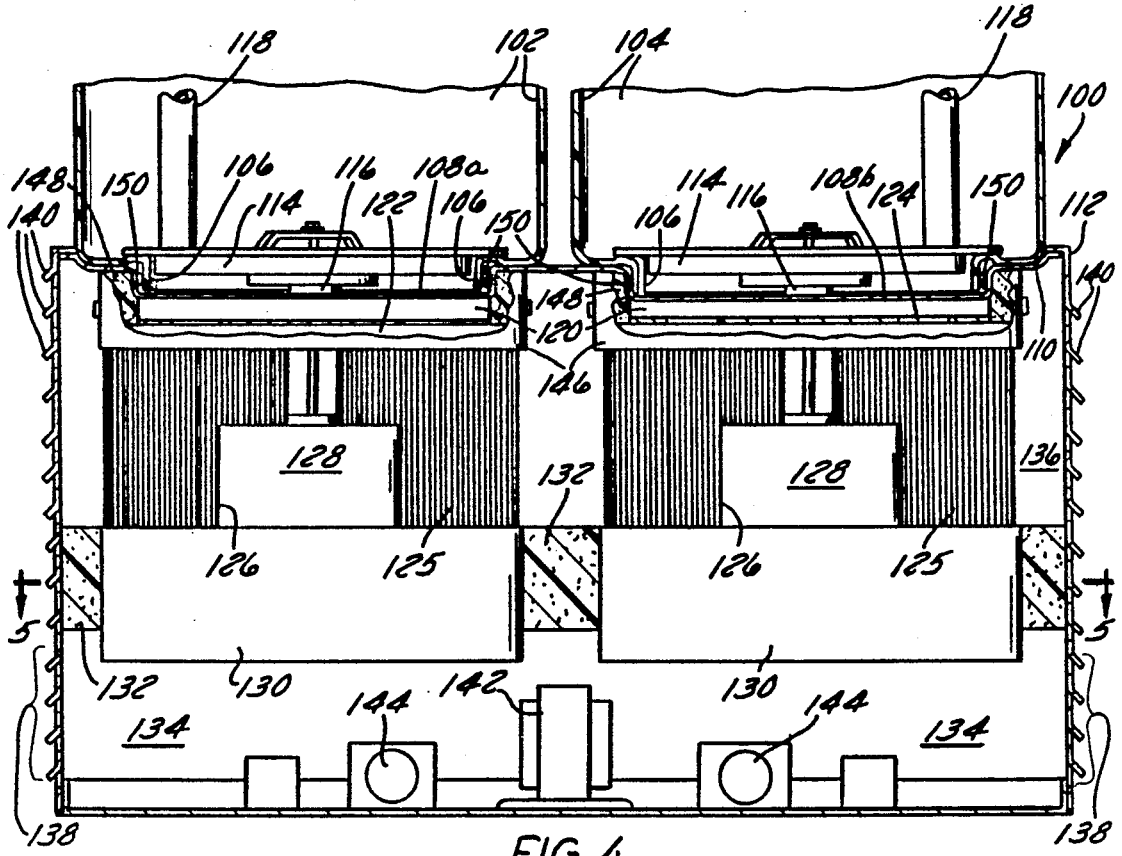
FIG. 4 shows a front elevation view of a thermoelectrically cooled dual bowl beverage dispensing machine with a forward portion as viewed being torn away for interior viewing, thus illustrating another preferred embodiment of my invention.
Figure 5:
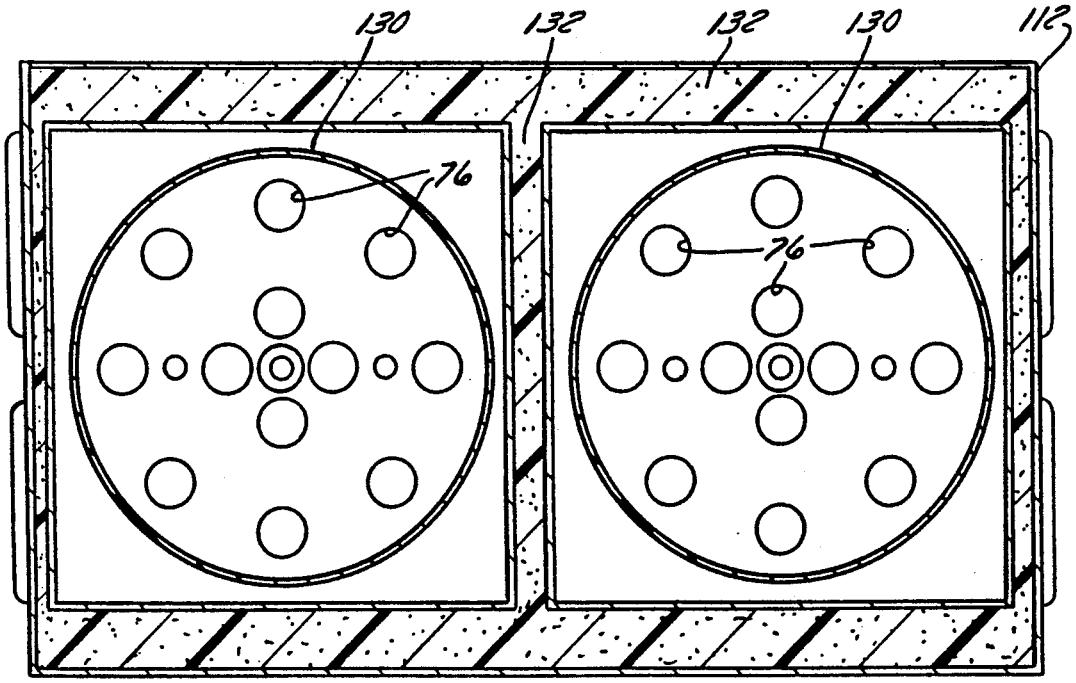
FIG. 5 shows a cross-sectional plan view of the machine of FIG. 4 with forward portions replaced, the same as viewed along cross-section lines 5—5 of the latter mentioned figure.

Referring now to FIGS. 4–5 a dual bowl thermoelectrically cooled beverage dispensing machine 100 is shown which includes a pair of transparent beverage containers 102, 104, each of which has a circular opening in it's base defined by a collar 106 which rests within a circular recess 108*a* and *b*, respectively, formed in a magnetically permeable, thermally conductive support plate 110. The plate 110 is attached to sidewalls of a housing 112 in any suitable manner. The sidewalls of the housing to which the support plate 112 is attached may be made of metal, molded plastic or other suitable material. The circular openings in the base of each container 102, 104 contain a removable cover 114 which defines a spiral or vortex guide of usual, well known type similar to that shown in the cover 24 of the machine of FIG. 1. The cover 114 contains openings through an upper central surface portion thereof which permits a beverage in the container thereabove to flow downward into the vortex guide. A rotatable magnetically driven impeller 116 located within a central portion of the vortex guide under each of the covers 114 circulates the beverage to a corresponding riser 118 for the same purposes and in the same manner as shown and described in relation to FIG. 1.

The machine 100 also includes a thermoelectric cooling assembly associated with and disposed below each of the support plate recesses 108*a* and 108*b*. Each of these assemblies is identical to the one shown and described in relation to FIGS. 1–3 and contains a cold plate 120, a hot plate 122, and a series of thermoelectric cooling modules 124 sandwiched therebetween. Attached to the base of each cold plate 120 is a series of rectangularly shaped heat radiating plates 125. Each bundle of plates 125 contains a space 126 in which a different fan motor 128 is disposed, which fan motors operates both a magnetic drive disc located in a central space within the hot and cold plates 120 and 122, and a fan located in a fan housing 130, the same as shown and described in the previous example.

A series of strips 132 of closed cell polyurethane foam disposed between and around the housing 112 and the fan housings 130 divides the interior of the housing 12 into a lower air inlet portion 134 and an upper air outlet portion 136. The fans in the housings 130 draw ambient air through baffled slots 138 located below the strips 132 and into circular openings in the bottoms of each of the fan housings 130, the same as shown in the previous example. Similarly, air drawn into the fan housings 130 is forced upwardly between the plates 125 and thence forwardly and rearwardly in the housing 112 as viewed in FIG. 4, above the strips 132 to ultimately be exhausted through baffled slots 140 located above the strips. The base of the housing 112 shows a transformer 142 similar to the transformer 96 of FIG. 2, capacitors 144, similar to the capacitor 94 of FIG. 2, and other components mounted thereon for use in the electrical circuitry of each of the thermoelectric cooling assemblies of the machine 100. Each of these circuits may be identical to the circuit shown in FIG. 2. The circular recesses 108*a* and 108*b* are thermally insulated from bands 146 which surround the cold and hot plates 120 and 122 by means of low density closed cell polyurethane foam linings 148. A resilient circular gasket 150 lies snugly between the collars forming the openings in the base of the containers 102 and 104 and the circular periphery of the recesses 108*a* and 108*b* in the support plate 110, to provide a liquid tight seal between these two elements to prevent beverage from leaking from the base of the containers 102 and 104 onto the support plate 110 beyond of the recesses 108*a* and 108*b*.

Although the present invention has been described and shown with respect to specific details of certain preferred embodiments thereof, it is not intended that such details limit the scope of my invention other than as specifically set forth in the following claims.

I claim:

1. In an improved refrigerated beverage dispensing machine of the type which conventionally includes a housing; a thermally conductive, magnetically permeable support plate attached to said housing; a transparent beverage container disposed on said support plate; a drive motor disposed in said housing; magnetic drive means responsively connected to said motor and disposed in said housing next to said support plate; and liquid circulating means rotatably disposed in said container next to said support plate; and liquid circulating means rotatably disposed in said container next to said support plate and being responsively coupled magnetically to said drive means, the improvement of which comprises A. a thermoelectric refrigeration system disposed in said housing for removing heat from said support plate to cool a beverage stored in said container, said refrigerating system including
(i) a cold plate attached to said support plate;
(ii) a hot plate mechanically fastened to but thermally isolated from said cold plate;
(iii) a series of thermoelectric modules sandwiched between said hot and cold plates, said hot and cold plates defining openings therethrough which are in registry with one another, said magnetic drive means being disposed within said openings and said modules being spaced around said openings; and
(iv) a plurality of heat exchanger plates mounted in thermal contact with said hot plate along a region of said hot plate extending from said hot plate defining opening to the outer periphery of said hot plate,
said modules being in thermal contact with said region of said hot plate and a centrally disposed group of said plurality of said plates being shorter and defining a void in which said motor is disposed; and B. air circulating means disposed within said housing for drawing ambient air into said housing along said heat exchanger plates to extract heat therefrom and for exhausting said air heated from contract with said heat exchanger plates from said housing, said air circulating means being responsively connected to said motor.

2. A multi-container beverage dispensing machine comprising

A. a housing;

B. at least a pair of transparent beverage containers, each of which contains a collar on a base portion thereof which defines a circular opening into said container;

C. a thermal conductive, magnetically permeable support plate attached to said housing and each containing at least a pair of spaced apart circular recesses therein, each of said recesses being adapted to receive a respective one of said collars, a different one of said containers being disposed on said support plate over a different one of said recesses;

D. a cover disposed over each of said circular openings, said cover defining a pathway thereunder;

E. a liquid circulating means rotatably disposed between said cover and support plate for circulating a beverage through said pathway, F. a drive motor disposed in said housing under each of said support plate recesses, G. a magnetic drive disc responsively connected to each said drive motor and located next to and under said support plate, each said drive disc being magnetically coupled to different one of said circulating means, H. a thermoelectric refrigerating system disposed in said housing under said support plate and under each of said support plate recesses, said thermoelectric refrigerating system including
(i) cold plate attached to said support plate;
(ii) a hot plate mechanically fastened to but thermally isolated from said cold plate;
(iii) a series of thermoelectric modules sandwiched between said hot and cold plates, said hot and cold plates defining openings therethrough which are in registry with one another, said magnetic drive means being disposed within said openings and said modules being spaced around said openings; and
(iv) a plurality of heat exchanger plates mounted in thermal contact with said hot plate along a region of said hot plate extending from said hot plate defining opening to the outer periphery of said hot plate,
said modules being in thermal contact with said region of said hot plate and a centrally disposed group of said plurality of said plates being shorter and defining a void in which said motor is disposed; and I. air circulating means disposed under each of said systems for drawing ambient air into said housing along said heat exchanger plates to extract heat therefrom and for exhausting said air heated from contact with said heat exchanger plates from said housing, each of said air circulating means being responsively connected to different one of said drive motors.

3. The machine of claim 1 wherein said air circulating means comprises a fan.

4. The machine of claim 1 wherein said housing comprises air inlet means formed in at least one surface portion of said housing through which ambient air is drawn into said housing by said air circulating means, air outlet means separate and distinct from said air inlet means formed in at least one surface portion of said housing through which ambient air heated by said refrigeration system is exhausted, and air insulating means disposed in said housing for dividing the air space in said housing outside of said refrigerating system to thereby isolate said air inlet means from said air outlet means.

5. The machine of claim 1 wherein said cold plate is attached to said support plate by means of an epoxy adhesive containing aluminum particles.

6. The machine of claim 1 wherein said support plate comprises at least one circular recess, said container containing a circular opening in a base portion thereof and being disposed in said recess, said liquid circulating means also being disposed in said recess, said cold plate being disc shaped and attached to said recess.

7. The machine of claim 4 wherein said air inlet means comprises a first series of spaced apart slots located on one vertical end portion of said housing, said air outlet means comprising a second series of spaced apart slots located on another vertical end portion of said housing.

8. The machine of claim 1 wherein said refrigerating means further comprises a series of spaced apart heat exchanger plates attached to said hot plate, said heat exchanger plates defining a void space therein, said motor being disposed in said void space.

9. The machine of claim 4 wherein said air insulating means comprises a closed cell polymer foam.

10. The machine of claim 1 further comprising an electrical circuit operatively connected to said modules comprising a full wave bridge rectifier for supplying a d.c. operating potential to said modules, a thermostatically controlled ON/OFF switch for connecting and disconnecting said potential to and from said modules, and a thermostat operatively connected to said switch and responsive to the temperature of said cold plate for applying said potential to said modules when the temperature of said cold plate is greater than a predetermined value.

11. The machine of claim 2 further comprising gasket means disposed between each said collar and a defining wall of a corresponding support plate recess for inhibiting leakage of a beverage out of each of said containers and its corresponding recess onto said support plate around said recess.

* * * * *